US006220702B1

(12) United States Patent
Nakamura et al.

(10) Patent No.: US 6,220,702 B1
(45) Date of Patent: Apr. 24, 2001

(54) INK BAG FOR INK JET TYPE RECORDING APPARATUS AND PACKAGE SUITABLE FOR PACKING SUCH INK BAG

(75) Inventors: Masahiro Nakamura; Takeshi Kobayashi; Masanori Kamijyo; Tadatoshi Honzawa; Michinari Tsukahara, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/471,335

(22) Filed: Dec. 23, 1999

(30) Foreign Application Priority Data

Dec. 24, 1998 (JP) ..... 10-367539
Aug. 23, 1999 (JP) ..... 11-234916

(51) Int. Cl.[7] ..... B41J 2/175; B65D 81/02; B65D 81/20

(52) U.S. Cl. ..... 347/86; 206/593; 206/594; 206/524.8

(58) Field of Search ..... 347/84–87; 222/92, 222/206, 574, 105; 206/484, 521, 592, 593, 594, 594.8; 383/80, 120; 141/114

(56) References Cited

U.S. PATENT DOCUMENTS

| | | | | |
|---|---|---|---|---|
| 2,160,816 | * | 6/1939 | Barnes | 206/586 |
| 3,595,441 | * | 7/1971 | Grosjean | 222/107 |
| 3,615,712 | * | 10/1971 | Keller | 426/113 |
| 4,415,886 | * | 11/1983 | Kyogoku et al. | 340/618 |
| 4,429,320 | * | 1/1984 | Hattori et al. | 347/86 |
| 4,447,820 | * | 5/1984 | Terasawa | 347/86 |
| 4,658,434 | * | 4/1987 | Murray | 383/66 |
| 4,669,124 | * | 5/1987 | Kimura | 383/80 |
| 4,759,446 | * | 7/1988 | Dobashi et al. | 206/586 |
| 4,887,912 | * | 12/1989 | Stumpf | 383/66 |
| 5,221,935 | * | 6/1993 | Uzita | 347/36 |
| 5,359,353 | * | 10/1994 | Hunt et al. | 347/86 |
| 5,373,965 | * | 12/1994 | Halm et al. | 222/92 |
| 5,400,066 | * | 3/1995 | Matsumoto et al. | 347/86 |
| 5,611,461 | * | 3/1997 | Kubota et al. | 222/105 |
| 5,691,755 | * | 11/1997 | Pawlowski, Jr. et al. | 347/86 |
| 5,699,936 | * | 12/1997 | Sakamoto | 222/107 |
| 5,924,198 | * | 7/1999 | Swanson et al. | 29/890.1 |
| 5,971,533 | * | 10/1999 | Kinoshita et al. | 347/86 |
| 6,030,652 | * | 2/2000 | Hanus | 426/107 |
| 6,053,606 | * | 4/2000 | Yamaguchi et al. | 347/86 |
| 6,105,821 | * | 8/2000 | Christine et al. | 222/105 |

FOREIGN PATENT DOCUMENTS

| | | | |
|---|---|---|---|
| 0 674 999 A2 | 10/1995 | (EP) | B41J/2/175 |
| 0 715 958 A2 | 6/1996 | (EP) | B41J/2/175 |
| 0 826 505 A2 | 3/1998 | (EP) | B41J/2/175 |
| 0 890 441 A2 | 1/1999 | (EP) | B41J/2/175 |
| 0 899 112 A2 | 3/1999 | (EP) | B41J/2/175 |

OTHER PUBLICATIONS

Japanese Abstract No. 05138895, dated Jun. 8, 1993.

* cited by examiner

*Primary Examiner*—N. Le
*Assistant Examiner*—Judy Nguyen
(74) *Attorney, Agent, or Firm*—Sughrue, Mion, Zinn, Macpeak & Seas, PLLC

(57) ABSTRACT

The ink bag is structured as follows: To the respective long side portions (1*a*, 1*b*, 2*a*, 2*b*) of a rectangular-shaped, thermally fusible first film forming the surface portions (1, 2) of the ink bag, there are attached, by thermal fusion, the long side portions of a rectangular-shaped, thermally fusible second film forming the side surface portions (3, 4) of the ink bag and having lower rigidity than the first film to thereby form a cylindrical body. The one-side short side portions (1*c*, 2*c*) of the surface portions of the ink bag are attached together by thermal fusion to form a bag body. An ink supply hole forming member (5) is attached by thermal fusion to the other-side short side portions of the surface portions of the ink bag. In the four corners of the ink bag, there are formed band-shaped connecting portions (6 to 9) each starting from one of the two mutually adjoining sides of the ink bag and reaching the other of the two sides.

28 Claims, 13 Drawing Sheets

FIG. 5(III)
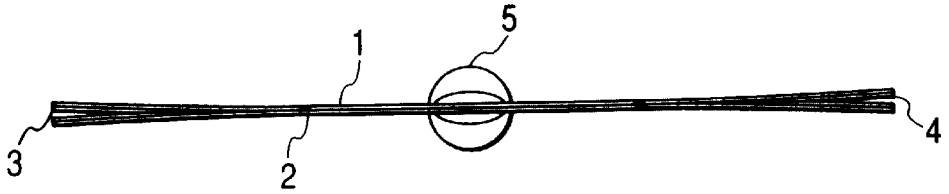

INK BAG FOR INK JET TYPE RECORDING APPARATUS AND PACKAGE SUITABLE FOR PACKING SUCH INK BAG

BACKGROUND OF THE INVENTION

1. Field of the Invention

The present invention relates to an ink container which is removably accommodated in a casing of an ink jet type recording apparatus to supply ink to a recording head and, in more particular, to a flexible ink bag for storing ink therein.

2. Description of the Related Art

An ink jet type recording apparatus performs a printing operation by reciprocating a recording head in the sheet width direction of a recording sheet. To supply ink from an ink supply source to the recording head while reducing the weight of a reciprocatingly moving section, a recording apparatus, which carries out a large amount of print, generally adopts an arrangement in which the ink supply source is disposed in a casing of the apparatus whereas ink is supplied through a tube to the recording head.

The ink jet type recording apparatus is designed to pressurize ink in a pressure generation chamber to thereby generate ink droplets. If the ink contains air bubbles therein, then the pressure generated is reduced due to such air bubbles to lower the ejection performance of the ink droplets. In order to avoid this problem, the ink jet type recording apparatus requires ink which eliminates dissolved air therefrom.

For this reason, an ink bag 60 shown in FIG. 14 is formed in the following manner: That is, a laminated film having a gas barrier property, which is composed of a polyethylene film and aluminum vapor-deposited on the polyethylene film, is folded at its center so that two half sections of the laminated film are superimposed one on the other. The three sides of the thus superimposed laminated film except for one. short side thereof are connected together by thermal fusion or any other suitable processing. The remaining one short side is sealed with an ink supply hole forming member 61 made of a plastic molding be secured thereto. Further, in order to protect the ink bag 60 from damage due to an external force or the like and to form an ink cartridge, the ink bag 60 is stored in a hard case 62 formed of high-molecular material. In FIG. 14, reference numeral 63 designates a plate member to be fixed to one side of the ink bag 60 to deform the ink bag 60 uniformly and enable detection of the ink end, and 64 designates a cover forming a part of the hard case 62.

However, the ink bag for commercial printing purpose must be supplied or distributed to a user without being stored in the hard case because the capacity of the ink bag 60 must be increased as well as the cost thereof must be reduced.

Therefore, the ink bag itself is required to have such strength as to withstand the distribution and a setting operation for setting the ink bag into a recording apparatus, but the increased strength of the ink bag hinders smooth reduction of the capacity of the bag in conjunction with the ink consumption by printing, which, in turn, incurs an obstacle to the supply of ink to the recording head. The ink bag, which is filled with ink, has such a rounded shape that the central portion of the ink bag is larger in thickness than the peripheral portions thereof, and therefore, the accommodation of the relatively rounded ink bag into an easy-to-handle rectangular case arises another problem in that space utility is low due to the presence of a dead space.

Moreover, if the ink storage capacity of the ink bag is increased, then the shaking or rocking motion of the ink during the distribution causes greater shocks to the ink bag, so that the ink bag is easy to break.

SUMMARY OF THE INVENTION

Accordingly, it is a first object of the invention to provide an ink bag which can secure such degree of strength as to be able to protect the ink bag from damage in handling when it is loaded into a recording apparatus.

A second object of the present invention is to provide an ink bag which can maintain its rectangular shape by itself in its ink filled state to thereby provide a high ink filling efficiency.

A third object of the present invention is to provide an ink bag which can supply ink to the recording apparatus positively.

A fourth object of the invention is to provide an ink bag which provides a rectangular shape in its ink filled state to thereby allow it to be stored in a recording apparatus with only a small dead space produced.

A fifth object of the invention is to provide an ink bag, which is able to receive external forces acting on the four corners of the ink bag in such a manner that the external forces are dispersed by four connecting portions formed in their associated four corners of the ink bag to thereby able to prevent the ink bag against damage as much as possible.

A sixth object of the invention is to provide an ink bag, which, according to the ink amount, can reduce the thickness of the side surface portions of the ink bag having relatively weak rigidity due to tensile forces given from connecting portions of the four corners of the ink bag to thereby be able to discharge ink positively.

A seventh object of the invention to provide a package for packing therein an ink bag in such a manner that the side surface portions of the ink bag are supported and held by and between the side surface inner packing members of the package, and the shoulder portions of the ink bag are supported and held by and between the end portion inner packing members of the package to eliminate a space for oscillation of the ink bag, thereby being able to prevent the ink bag from being damaged by large shocks that could be possibly applied to the ink bag during distribution.

An ink bag according to a preferred embodiment of the invention is structured such that, to the respective long side portions of a rectangular-shaped, thermally fusible first film forming the surface portions of the ink bag, there are attached, by thermal fusion, the long side portions of a rectangular-shaped, thermally fusible second film forming the side surface portions of the ink bag and having lower rigidity than the first film to thereby form a cylindrical body. The one-side short side portions of the surface portions of the ink bag are attached together by thermal fusion to thereby form a bag body. An ink supply hole forming member is attached by thermal fusion to the other-side short side portions of the surface portions of the ink bag. In the four corners of the ink bag, there are formed strip-like connecting portions each starting from one of the two mutually adjoining sides of the ink bag and reaching the other of the two sides.

An ink bag package according to a preferred embodiment of the invention includes end portion inner packing members, each having a trapezoidal-shaped section, for holding between them the end portion areas of the short-side sides of the ink bag from both surfaces thereof. The package further includes rectangular-shaped side surface inner packing members to be respectively contacted with the side surfaces of the long-side sides of the ink bag. A container is provided for storing therein theses inner packing members together with the ink bag.

The present disclosure relates to the subject matter contained in Japanese patent application Nos. Hei. 10-367539 (filed on Dec. 24, 1998) and Hei. 11-234916 (filed on Aug. 23, 1999), which are expressly incorporated herein by reference in their entireties.

DESCRIPTION OF THE PREFERRED EMBODIMENT

Figure 1A:
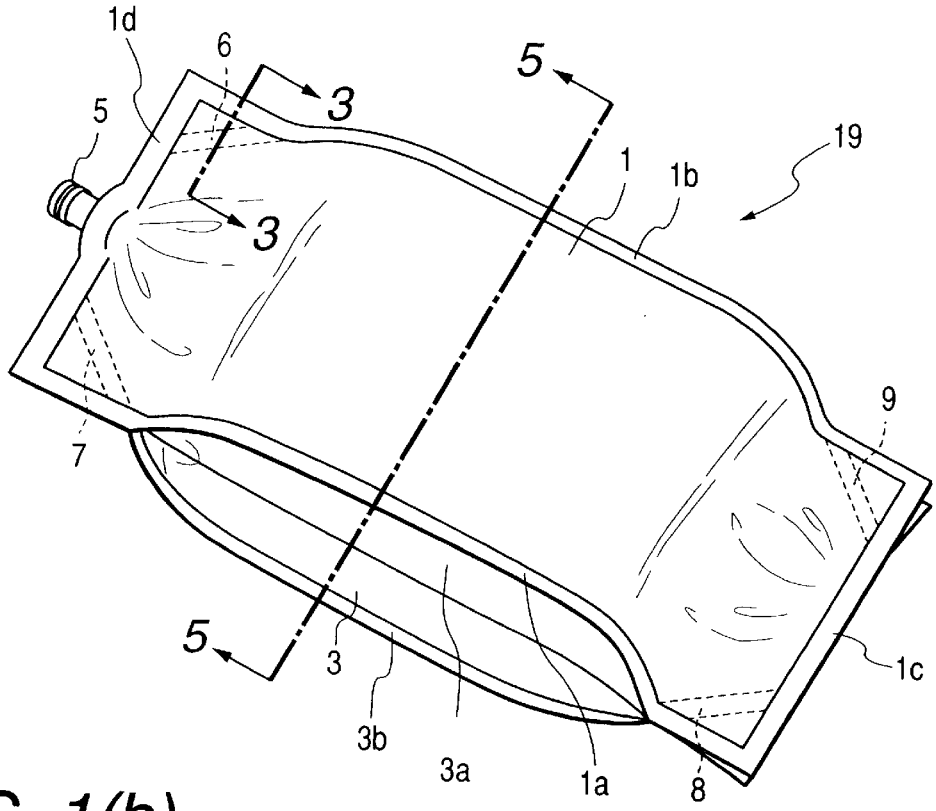
FIGS. 1(*a*) and (*b*) are respectively a perspective view and a part ally cutaway perspective view of an ink bag according to an embodiment of the invention.
Figure 1B:
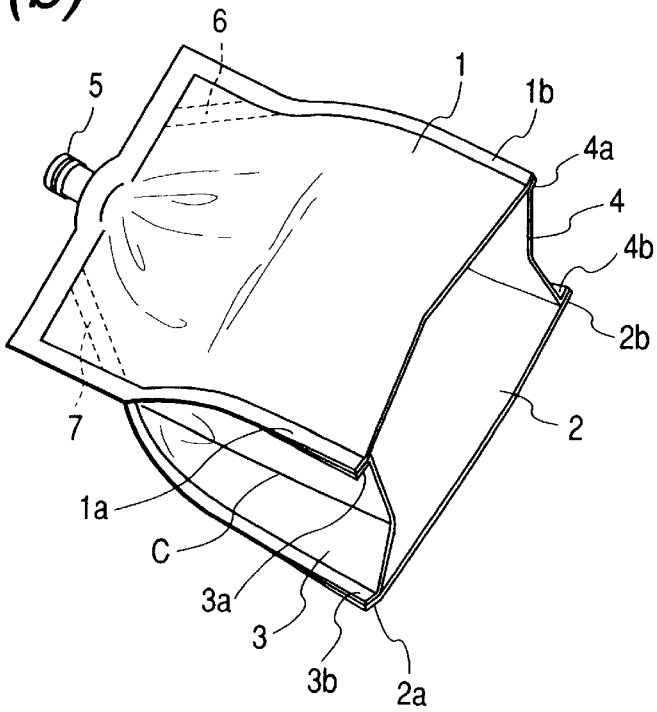
Figure 2A:
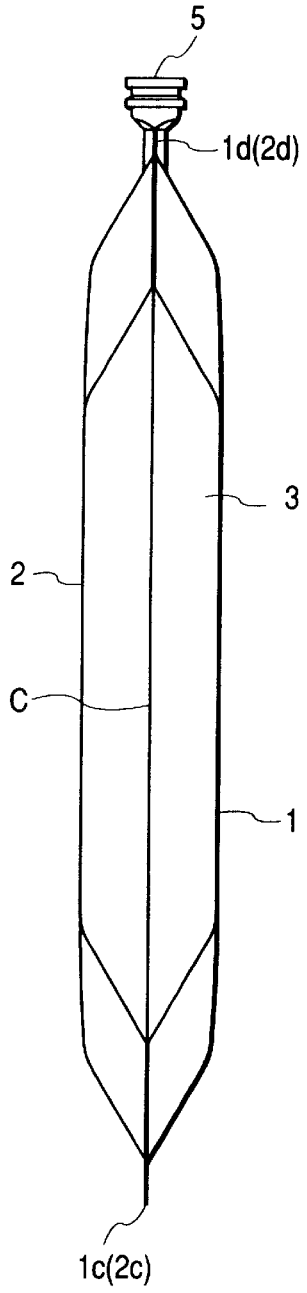
FIGS. 2(*a*) and (*b*) are respectively a side view of the ink bag, showing its ink filled state, and a top view thereof, showing its folded state.
Figure 2B:
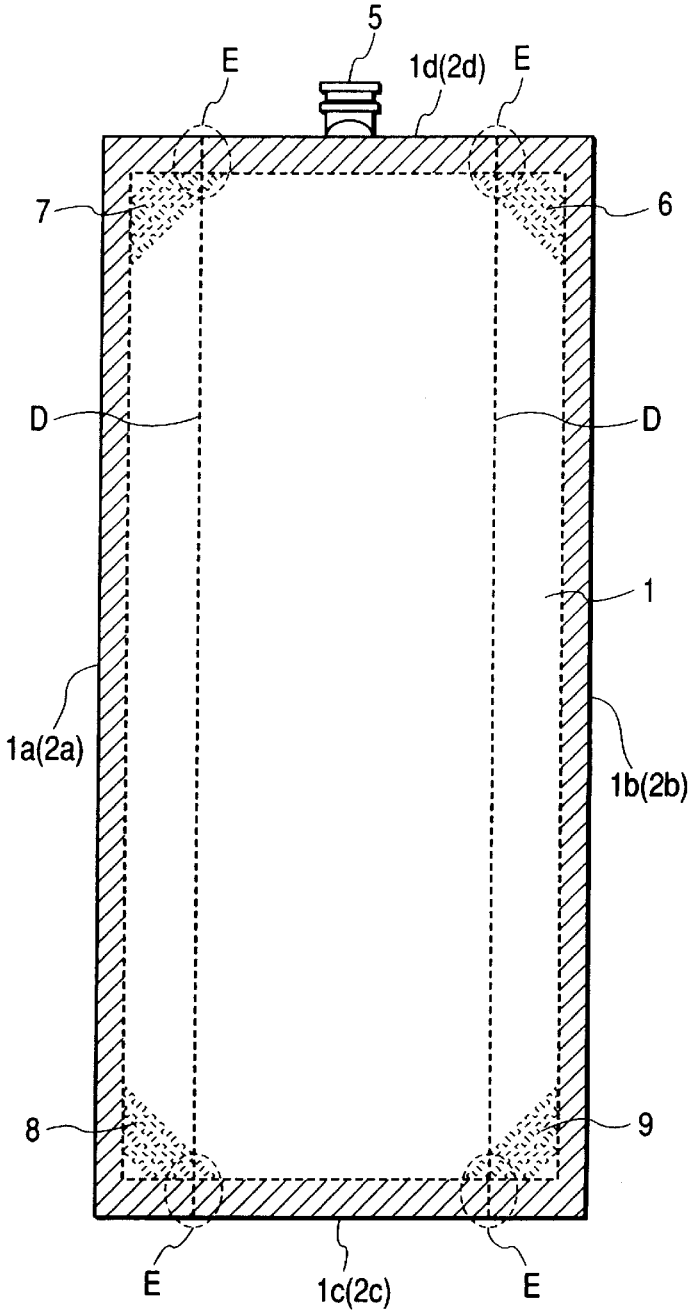

Now, FIGS. 1(*a*), (*b*) and FIGS. 2(*a*), (*b*) show an ink bag 19 according to an embodiment of the invention. The ink bag 19 has first rectangular films 1 and 2 as top and bottom surfaces, second rectangular films 3 and 4 as side surfaces, and an ink supply hole forming member 5. The second rectangular films 3 and 4 are lower in rigidity than the first rectangular films 1 and 2. To this end, each of the second rectangular films 3 and 4 may be folded, for instance, along a center line C, may be formed by selecting different material than the first rectangular films 1 and 2, etc. The ink bag 19 is formed, preferably, by the following procedure: The first films 1 and 2 are aligned together in a state that the second film 3 and 4 each folded along the center line C are interposed therebetween. The long side portions 1*a*, 1*b*, 2*a*, and 2*b* of the first films 1 and 2 are respectively attached to the long side portions 3*a*, 4*a*, 3*b* and 4*b* of the second films 3 and 4, for instance, by thermal fusion, to thereby form a hollow assembly. One end of the hollow assembly is closed, whereas the ink supply hole forming member 5 is attached to the other end of the hollow assembly. In this embodiment, the central portions of the short side portions 1*c* and 2*c* of the first films 1 and 2 are attached by thermal fusion to each other, and the remaining portions of the short side portions 1*c* and 2*c* of the first films 1 and 2 are attached by thermal fusion to the short side portions of the second films 3 and 4. Further, in this embodiment, the central portion of the short side portion 1*d* of the first film 1 is attached by thermal fusion to either of the central portion of the short side portion 2*d* of the first film 2 and the outer periphery of the ink supply hole forming member 5, the central portion of the short side portion 2*d* of the first film 2 is attached by thermal fusion to either of the central portion of the short side portion 1*d* of the first film 1, and the remaining portions of the short side portions 1*d* and 2*d* of the first films 1 and 2 are attached by thermal fusion to the short side portions of the second films 3 and 4. The half of the second film 3 (4) with respect to the central line C, which extends along the short side 1*c*, may be attached to the other half of the second film 3 (4) or may be separated therefrom. The ink bag 19 of this embodiment is further formed with connecting portions 6 to 9 at its four corners. Each of the connecting portions 6 to 9 is formed, by thermal fusion, as a strip extending obliquely from one side of the ink bag 19 to another adjacent side of the ink bag 19 and across the folding line D (i.e. the central line C) as best shown in FIG. 2.

Figure 3A:
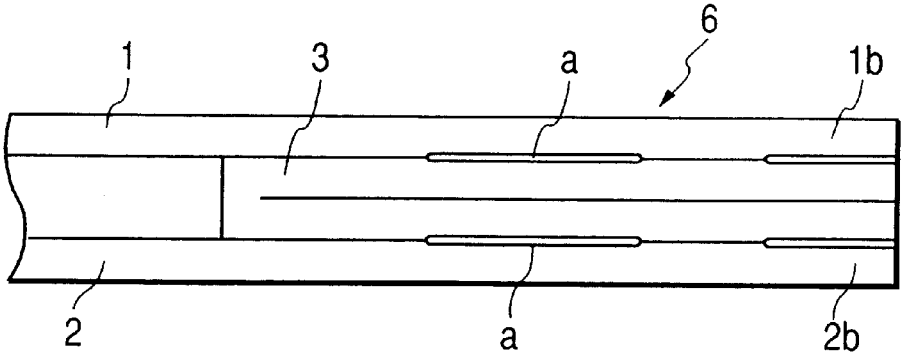
FIGS. 3(*a*) and (*b*) are sectional views taken along a line 3—3 of FIG. 1(*a*), showing two examples for a corner portion.
Figure 3B:
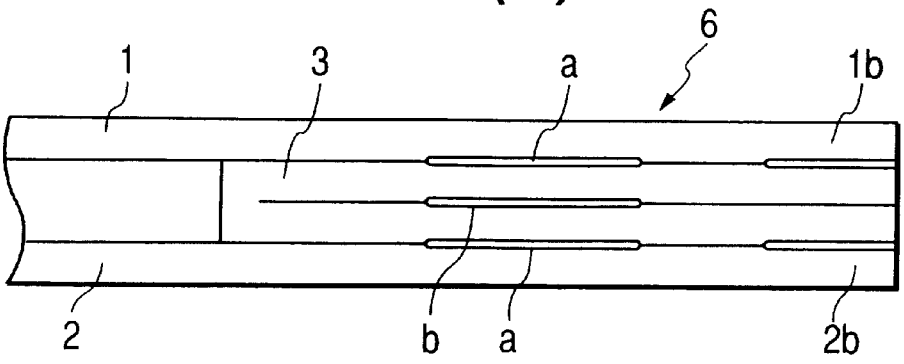
Figure 4A:
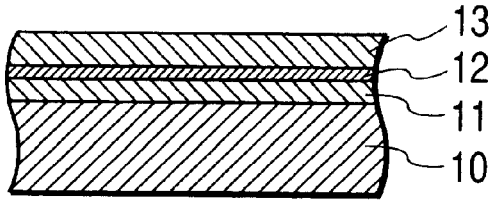
FIGS. 4(*a*), (*b*), (*c*) and (*d*) are section views of examples for a film used to form the ink bag.
Figure 4B:
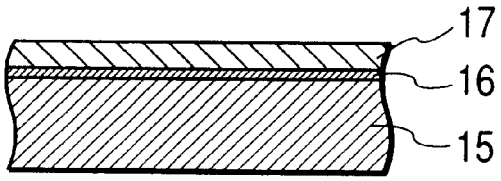
Figure 4C:
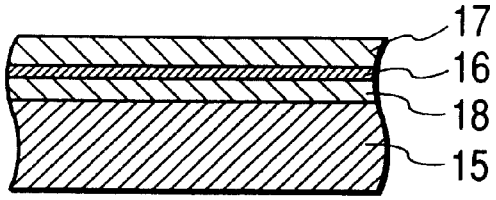
Figure 4D:
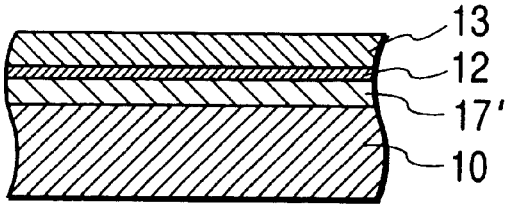
Figure 6:
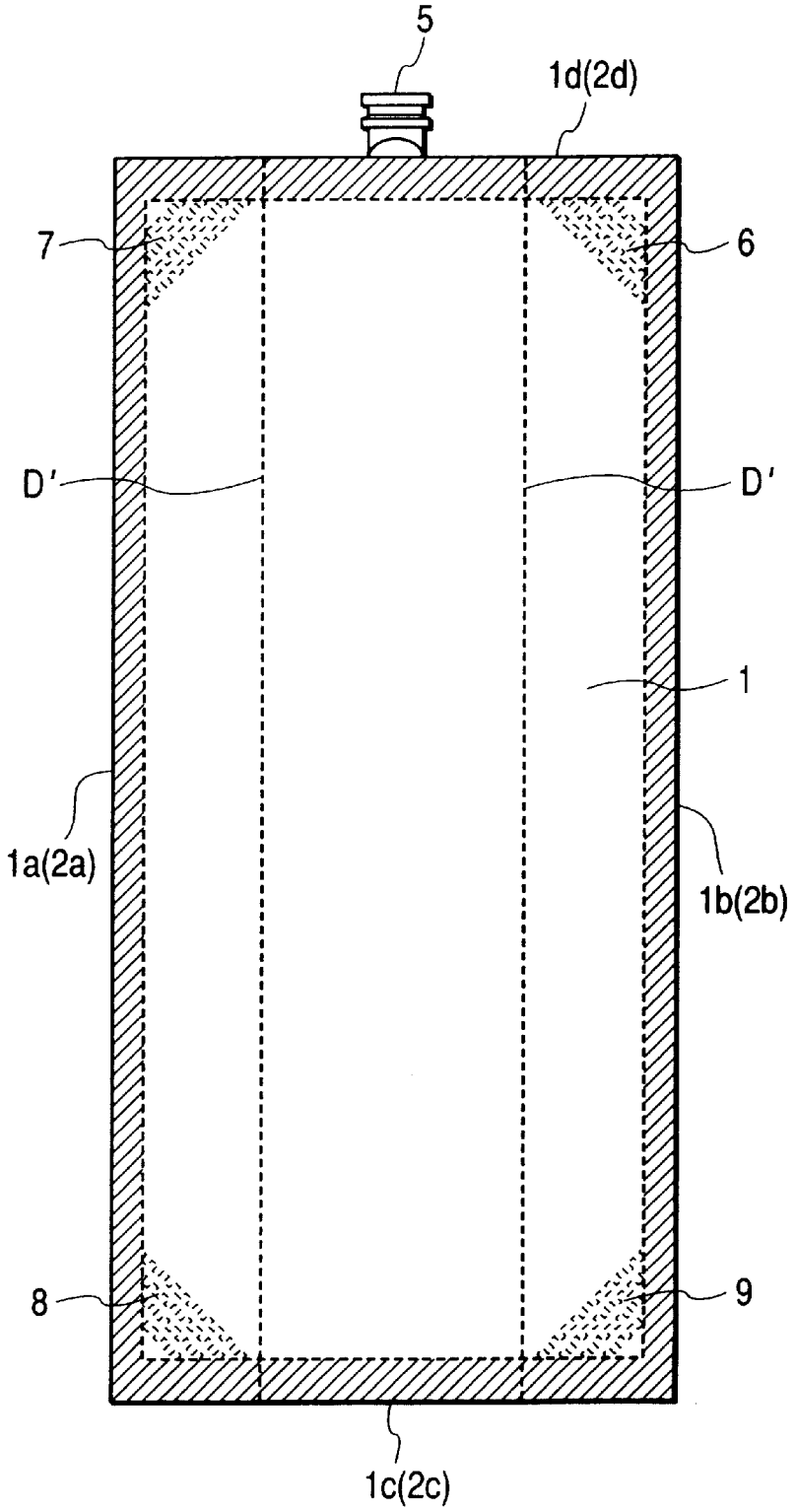
FIG. 6 is a top surface view of an ink bag in its folded state according to another embodiment of the invention.

As shown in FIG. 6, the connecting portions 6 to 9 may be formed not to extend across the folding lines D'. However, the former case in which the folding lines D of the second films 3 and 4 are situated on the connecting portions 6 to 9 as shown in FIG. 2 is advantageous, from the viewpoint of reinforcement, over the latter case in which the folding lines D' of the second films 3 and 4 are situated inwardly of the connecting portions 6 to 9 as shown in FIG. 6, since the connecting portions 6–9 of the former case can more positively reinforce the areas E of the ink bag 19, where the first films 1 and 2 and the second film 3 or 4 are overlapped together in a complicated manner. As shown in FIG. 3(*a*), each of the connecting portions 6 to 9 is formed such that the first films 1 and 2 are attached to the second film 3 or 4 at thermally fused areas a. That is, the thermally fused areas a is located between mutually contacting surfaces of the first film 1 (2) and the second film 3 (or 4) within the interior of the ink bag 19. The connecting portion 6 (to 9) of this arrangement can provide sufficient strength to the ink bag 19, but if larger strength is required, then it is preferable to further attach the half of the second film 3 (4) to the other half of the second film 3 (4) as illustrated by a thermally fused area b in FIG. 3(*b*). That is, in FIG. 3(*b*), the mutually contacting surfaces of the halves of the second film 3 (4), which are located outside the ink bag 19, are attached to each other at the thermally fused area b.

Each of the first films 1 and 2 preferably has such a laminated structure as shown in FIG. 4(*a*), which includes a polyethylene layer 10 of about 100 $\mu$m thickness, apolyester layer 11 of about 25 $\mu$m thickness, a gas-impermeable and flexible metal layer, such as an aluminum layer 12, of about 15 $\mu$m thickness, and, a protective layer, such as a polyester layer 13, of about 38 $\mu$m thickness. Each of the second films 3 and 4 preferably has such a laminated structure as shown in FIG. 4(*b*), which includes a polyethylene layer 15 of about 60 μm thickness, a gas-impermeable and flexible metal layer, such as aluminum layer 16, of about 9 μm thickness, and a protective layer, such as a flexible nylon layer 17, of about 15 μm to 25 μm thickness. As shown in FIG. 4(*c*), the second film 3, 4 may further has another nylon layer 18 interposed between the polyethylene layer 15 and w aluminum layer 16.

Since polyethylene can provide excellent adhering property as a consequence of thermal fusion, the above-exemplified laminated structure for the films 1, 2, 3 and 4 are advantageously useful to readily provide the ink bag 19 having sufficient connection strength and sufficient airtightness using the thermal fusion. The polyethylene layer 10 of the each of the first film 1 and 2 is attached by thermal fusion to the peripheries of the polyethylene layers 15 of the second films 3 and 4 in a state that each of the second films 3 and 4 has been folded at the central line C and aligned to the first films 1 and 2. It is generally known that the polyethylene is lower in fusing or melting point than the nylon. Therefore, if it is required that the polyethylene layer 10 of the first film 1 is attached by thermal fusion to the polyethylene layer 15 of the second film 3 but the nylon layer 17 on the half of the second film 3 should not be attached to the nylon layer 17 of the other half of the second film 3 as in the case for the portion X marked in FIG. 1(*a*), then the heat to be applied to the first and second films 1 and 3 for thermal fusion is selected to cause thermal fusion on of the mutually contacting polyethylene surfaces but not cause on the mutually contacting nylon surfaces. If it is required, as shown in FIG. 3(*b*), that the polyethylene layer 10 of the first film 1 is attached to the polyethylene layer 15 of the second film 3 and the nylon layer 17 on the half of the second film 3 is also attached to the nylon layer 17 of the other half of the second film 3, then the heat to be applied to the first and second films 1 and 3 for thermal fusion is selected to cause thermal fusion on both of the mutually contacting polyethylene surfaces and the mutually contacting nylon surfaces. Alternatively, an adhesive may be applied to the mutually contacting nylon surfaces, or a suitable material for the second film 3 may be selected in place of the nylon layer 17.

Figure 5I:
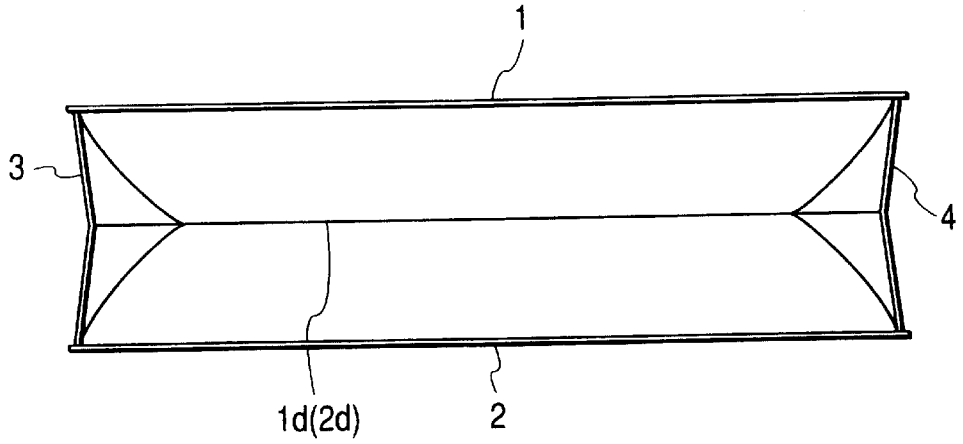
FIGS. 5(I), (II) and (III) are sectional views taken along a line 5—5 of FIG. 1, showing deforming steps of the ink bag in conjunction with reduction of ink amount.

After degassed ink is filled through an ink supply hole of the ink supply hole forming member 5 into the ink bag 10 thus formed, the ink supply hole is sealed by a septum. The ink bag 19 filled completely with ink is inflated or expanded into a relatively flat and substantially parallelepiped shape as shown in FIG. 5(I) while the connecting portions 6–9 at four corners and the short side portions 1*c*, 1*d*, 2*c*, 2*d*, etc. of the ink bag 19 prevent unnecessary expansion of the ink bag 19. In this state, even if the ink bag is given an excessive force due to its fall or the like, the four corners of the ink bag 19 is protected by the relatively wide connecting portions 6 to 9 which serve to disperse the applied excessive force. Therefore, the ink bag 19 is free from the damage.

Because the stored ink is in contact with the chemically stable polyethylene layers 10 and 15, the ink remains unchanged chemically. Further, since the aluminum layers 12 and 16 isolate the ink inside the ink bag from ambient air, the degassed condition of the ink can be maintained for a long period of time. That is, the quality of the ink applied when it is shipped from a factory can be maintained for a long time.

Figure 5:
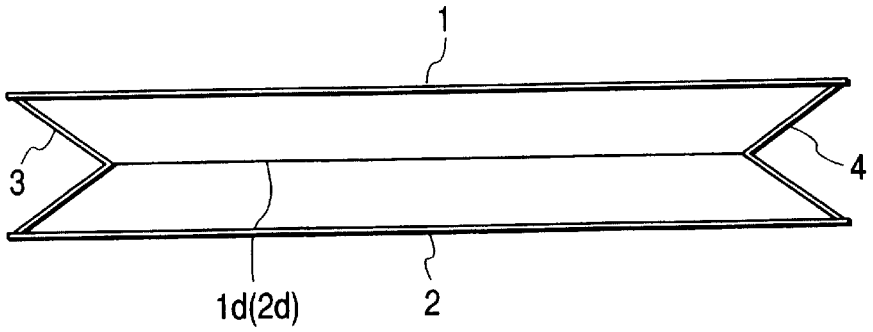

When an ink supply needle disposed in a recording apparatus is inserted into the ink supply hole of the member 5, the ink in the ink bag is supplied through an ink supply tube to a recording head. As the consumption of the ink by the recording head advances, the relatively weak side surface portions, i.e. the films 3 and 4, are deformed in conjunction with the consumed amount of the ink to reduce the thickness of the ink bag 19. In particular, since each of the films 3 and 4 has such a tendency as to be deformed along the central line C and the connecting portions 6 to 9 effectively serve to transmit tensile forces from the first films 1 and 2 to the second films 3 and 4 to move the center lines C of the second films 3 and 4 inwardly, the thickness reduction of the ink bag 19 in conjunction with the ink consumed amount is facilitated (FIG. 5(II)). At the final stage in which the ink is consumed completely, the side surface portions, i.e. the second films 3 and 4, are folded completely so that the half of the second film 3 (4) is contacted with the other half of the second film 3 (4) as well as the one of the first films 1 and 2 is contacted with the other of the first films 1 and 2. Thus, the ink stored in the ink bag can be discharged completely and surely (FIG. 5(III)).

FIG. 4(*d*) is another preferable example for each of the first films 1 and 2. A difference of the structure shown in FIG. 4(*d*) from the structure shown in FIG. 4(*a*) is that the intermediate polyester layer 11 in the structure shown in FIG. 4(*a*) is replaced with a nylon layer 17'. This structure makes it possible to more positively prevent the damage and breakage of the ink bag 19 caused due to the shaking or rocking motion of the ink, the impact applied to the ink bag 19 or the like, since the nylon superior in breaking strength to polyester is incorporated as an intermediate layer to the laminated structure. In addition, the polyester layer 13 (and 11) serves to assist or facilitate the folding of the ink bag 19 in conjunction with the ink consumption as described with reference to FIG. 5, since the polyester possesses a certain rigidity or tension. That is, the provision of the polyester layer 13 (and 11) makes it possible to surely discharge the ink from the interior of the ink bag 19.

Figure 7:
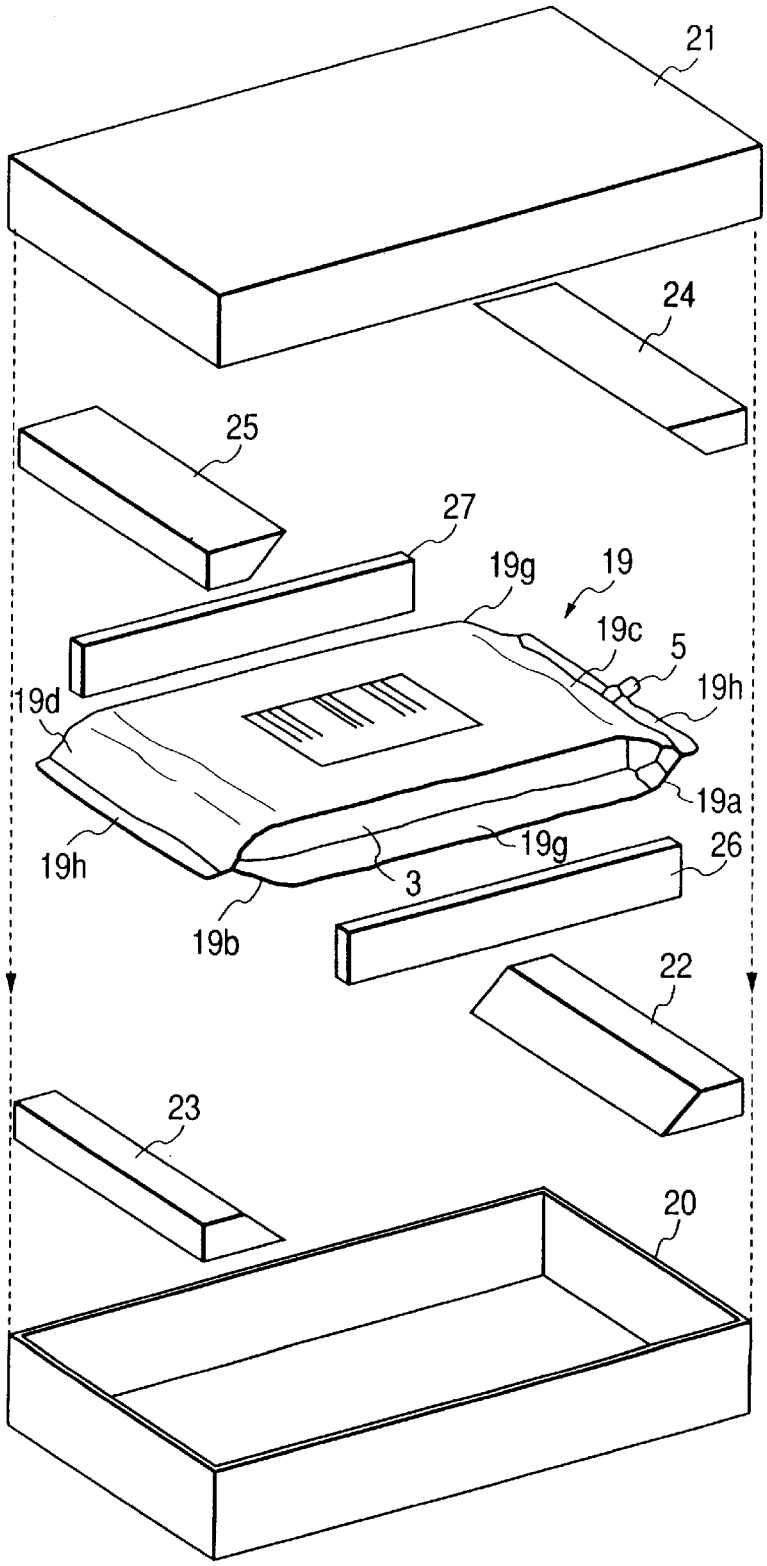
FIG. 7 is a perspective view of a package suitable for an ink bag, which constitutes an embodiment of the invention.

FIG. 7 shows an example of a package which is preferably used to pack the above-mentioned ink bag 19 to improve the handling of the ink bag 19 during distribution to a user. Note that the ink bag 19 shown in FIG. 7 is not formed with the connecting portions 6 to 9, but may have the connecting portions 6 to 9 similarly to the ink bag 19 shown in FIG. 1. The present package comprises an outer packing member, which is composed of a box-shaped container main body 20 having a depth L1 smaller than the thickness d of the ink bag 19 and a box-shaped upper cover 21, four end portion inner packing members 22, 23, 24 and 25 respectively including inclined surfaces almost identical with the inclined surfaces of their associated end portions of the ink bag 19 on the long-side side thereof and each having a trapezoidal-shaped section, and two side surface inner packing members 26 and 27 which can be respectively inserted into their associated recesses formed in the two side surfaces of the ink bag 19.

The four end portion inner packing members 22 to 25 are structured such that, when the pair of the inner packing members 22 and 24 (or the pair of the inner packing members 23 and 25) hold the end portion (short side) 19*h* of the ink bag 19 therebetween to be respectively contacted with the upper and lower surfaces of the end portion 19*h*, a total height L2 of the pair of the end portion inner packing members 22 and 24 (or 23 and 25) is larger than the depth L1 of the container main body 20 and smaller than the maximum thickness d of the ink bag 19. In the present embodiment, each of the end portion inner packing members 22 to 25 is manufactured by molding high-molecular foaming material into a trapezoidal cross-sectional shape to have a perpendicular surface on one end side and an inclined surface on the opposite side, which substantially matches with a corresponding one of shoulder portions 19*a* to 19*d* of the ink bag 19. Each of the side surface portion inner packing members 26 and 27, in the present embodiment, is manufactured by molding high-molecular foaming material into a rectangular cross-sectional shape. The lateral thickness of the side surface portion inner packing member 26 (27) is set such that, when the side surface portion inner packing member 26 (27) is installed onto the second film 3 (4) of ink bag 19, the surface of the side surface portion inner packing member 26 (27) is slightly protruded laterally from the ink bag 19.

To pack the ink bag 19 in the present embodiment, the end portion inner packing members 22 and 23 are first placed on the two ends of the bottom portion of the container main body 20 in such a manner the inclined surfaces thereof face upwardly. Thereafter, the ink bag 19 is placed onto the thus placed end portion inner packing members 22 and 23 in a state that the side surface inner packing members 26 and 27 have been inserted to respectively abut the side surfaces (the second films) 3 and 4 of the ink bag 19. Thereafter, the end portion inner packing members 24 and 25 are placed onto the two end portions of the container main body 20 with their inclined surfaces facing downward, and an upper cover 21 is then set onto the container main body 20.

Figure 8A:
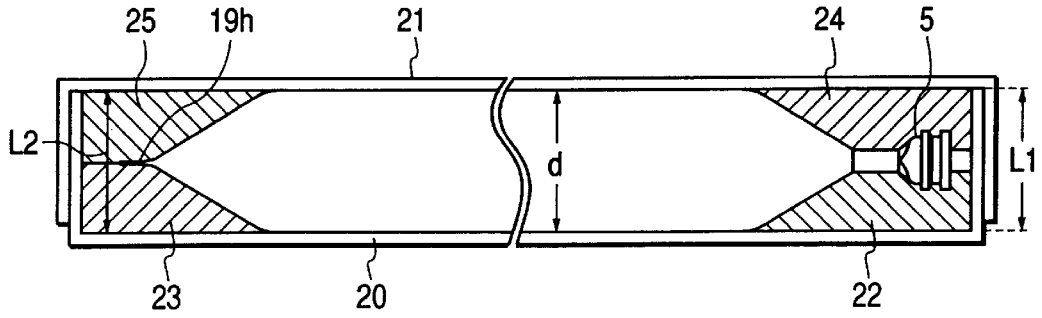
FIGS. 8(*a*) and (*b*) are a section view taken along the long-side of the package and a section view taken along the short-side side thereof, showing a state in which the ink bag is packed by the above package.
Figure 8B:
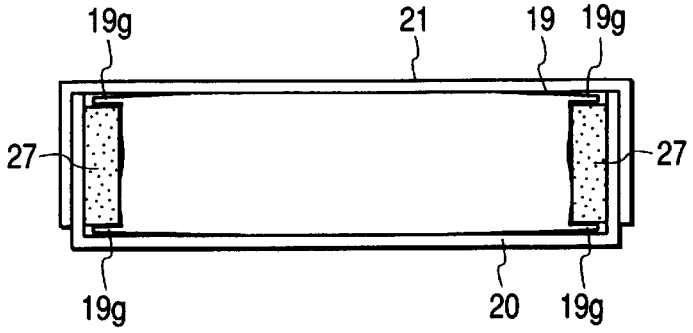

Accordingly, as shown in FIGS. 8(*a*) and (*b*), the ink bag 19 is stored within and between the package main body 20 and upper cover 21 in such a manner that the side surface portions 3 and 4 of the ink bag 19 are restricted by the side surface inner packing members 26 and 27, the attached portions 19*g* of the ink bag 19 are situated laterally inward of the upper or lower surfaces of the side surface inner packing members 26 and 27, the shoulder portions 19*a* to 19*d* of the ink bag 19 are respectively supported by their associated end portion inner packing members 22 to 25, and the attached portions 19*h* of the ink bag 19 are held by and between their associated end portion inner packing members 22 to 25.

Figure 9A:
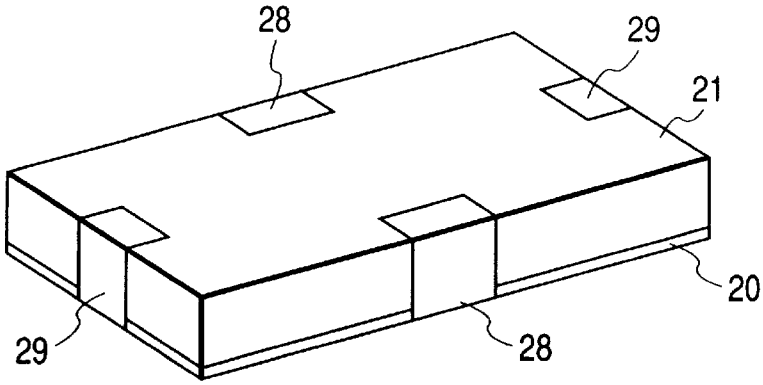
FIGS. 9(*a*) and (*b*) are perspective views of the above package, showing respective packing steps in which the ink bag is packed by and into the package.
Figure 9B:
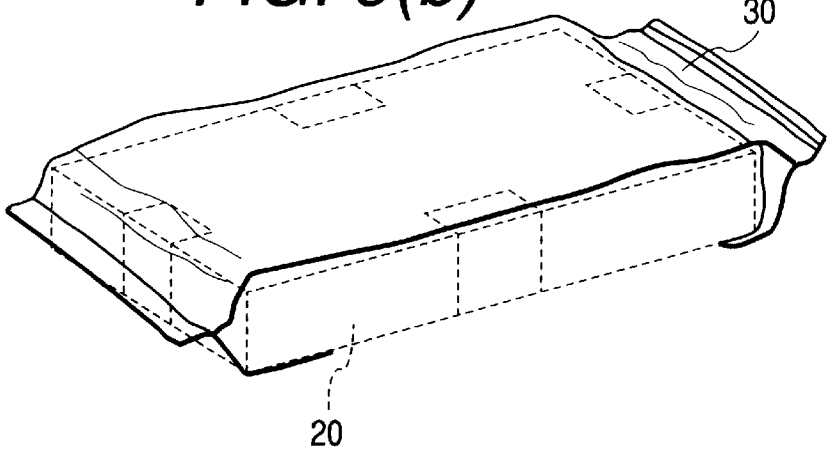
Figure 10:
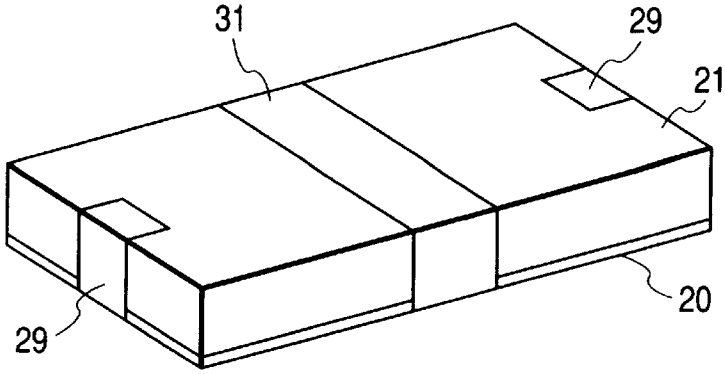
FIG. 10 is a perspective view of a package according to the invetion

In this state, as shown in FIG. 9(*a*), the package main body 20 and upper cover 21 are fixed together by adhesive tapes 28 and 29 to complete a package, and then, as shown in FIG. 9(*b*), the package is enclosed into an ink leakage preventive bag 30. As shown in FIG. 10, if an adhesive tape 31 is wound entirely around the longitudinal central portions of the package main body 20 and upper cover 21 to thereby fix them, then the tensile force of the adhesive tape 31 can prevent the package main body 20 and upper cover 21 from being expanded.

By the way, if the depth L1 of the package main body 20 is set smaller than the thickness d of the ink bag 19, preferably, in such a manner that $L1 \leqq (0.7–1.0)\ d$, then the upper cover 21 and package main body 20 are closely contacted with the front and back surfaces of the ink bag 19 respectively, which makes it possible not only to prevent the ink bag 19 from being twisted or bent due to shocks or the like but also to prevent the ink bag 19 from oscillating when vibrations are given to the package.

Further, since the total height L2 of the pair of the end portion inner packing members 22 and 24 (23 and 25) is set larger than the depth L1 of the package main body 20, the attached portions 19*h* on the short-side side of the ink bag 19 can be held by and between the end portion packing members 22 to 25 more positively as well as the inclined surfaces of the end portion packing members 22 to 25 are respectively contacted with the shoulder portions 19*a* to 19*d* of the ink bag 19. Accordingly, the shape of the ink bag 19 can be maintained.

Further, because the total height L2 of the pair of the end portion inner packing members 22 and 24 (23 and 25) is set smaller than the maximum thickness d of the ink bag 19, the package main body 20 and upper cover 21 are both closely contacted with the surfaces of the ink bag 19 to thereby be able to positively prevent the ink bag 19 from being twisted and oscillated due to shocks and vibrations.

Figure 11A:
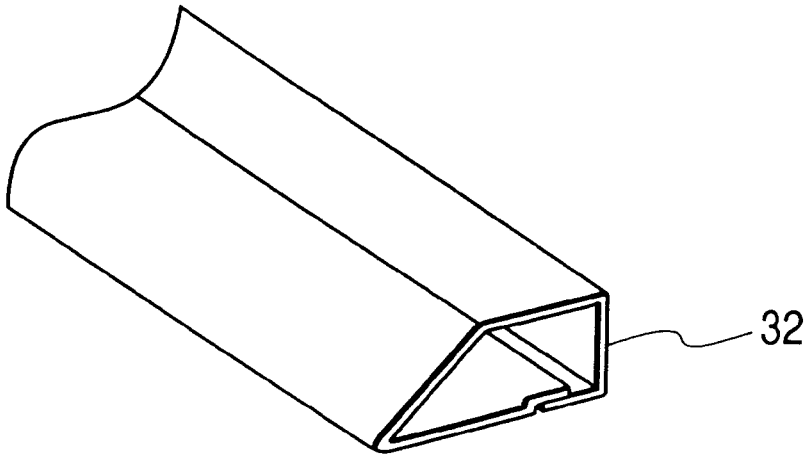
FIGS. 11(*a*) and (*b*) are respectively views of examples of the end portion inner packing member and side portion inner packing member used in the package of the invention.
Figure 11B:
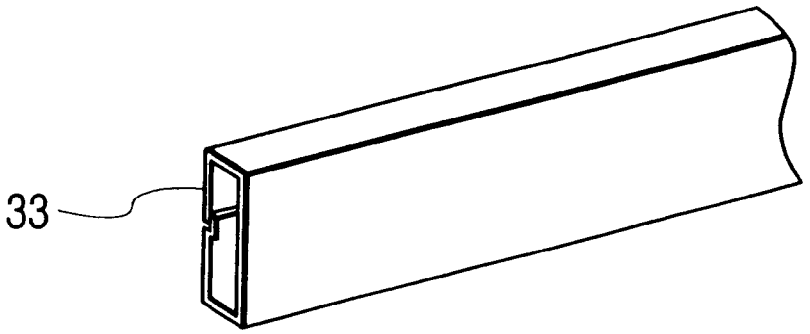

In the above-mentioned embodiment, the inner packing members 22 to 27 are each made of foaming material. However, as shown in FIGS. 11(*a*) and (*b*), even if the inner packing members 22 to 27 are structured by bending plate members 32, 33 such as cardboard plates or the like or by injection molding high-molecular material into a cylindrical shape, they can also provide similar effect.

Figure 12A:
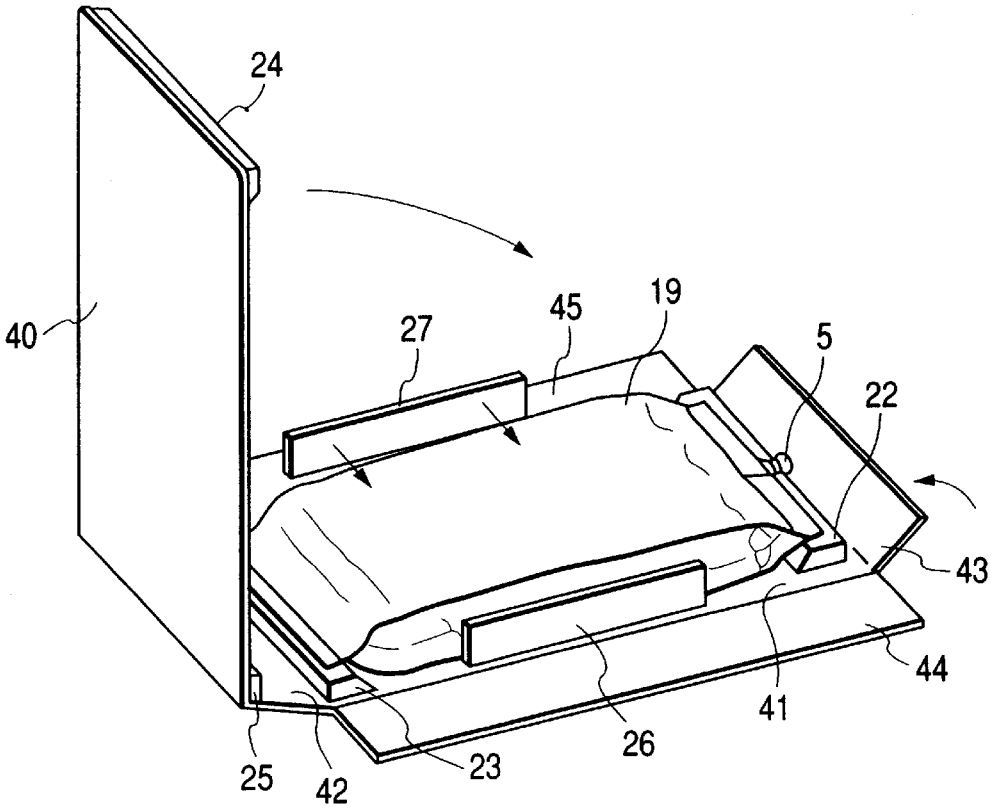
FIGS. 12(*a*) and (*b*) are perspective views of another package according to the invention, showing their packing steps respectively.
Figure 12B:
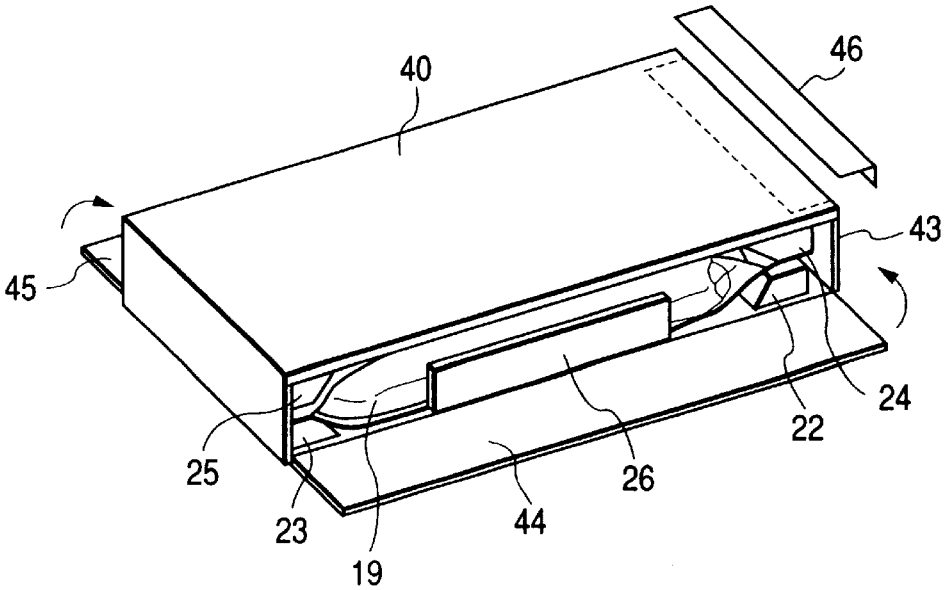

Now, FIGS. 12(*a*) and (*b*) show another embodiment of a package according to the invention. In the present embodiment, a plate member suitable for packing of an ink bag such as a cardboard plate, a high-molecular material member or the like is cut into a predetermined shape that has a top plate 40, a bottom plate 41, and side plates 42, 43, 44, 45 and that can be formed into a box-like shape. The end portion inner packing members 24, 25 and 22, 23 are fixed by adhesives or the like to the longitudinal end portions of the top plate 40 and bottom plate 41 at given positions to hold the end portions of the ink bag 19.

Side surface inner packing members 26 and 27 are mounted onto the two side surfaces of the ink bag 19 and they are all placed onto the bottom plate 41. As shown in FIG. 12(*b*), the top plate 40 and side plate 43 having its short-side side opened are folded, and the connecting portion between the top plate 40 and side plate 43 is fixed using adhesive tape 46. Then, the side plates 44 and 45 disposed on the long-side sides of the package are both folded and, if necessary, the side plates 44, 45 and top plate 40 are provisionally secured to each other by adhesive tape. Thereafter, similarly to the case shown in FIG. 9(*b*), the ink bag 19 and package are enclosed. into an ink leakage preventive bag 30.

Especially, it is preferably that the ink leakage preventive bag 30 is structured as a vacuum pack. In this case, the ambient air pressure is allowed to act uniformly on the outer peripheries of the top plate 40, bottom plate 41, and side plates 42, 43, 44, 45 and, concurrently, resisting forces of the end portion inner packing members 22 to 25 are applied to the inner surfaces of the plates 40 to 45, thereby being able to maintain the box shape.

Figure 13:
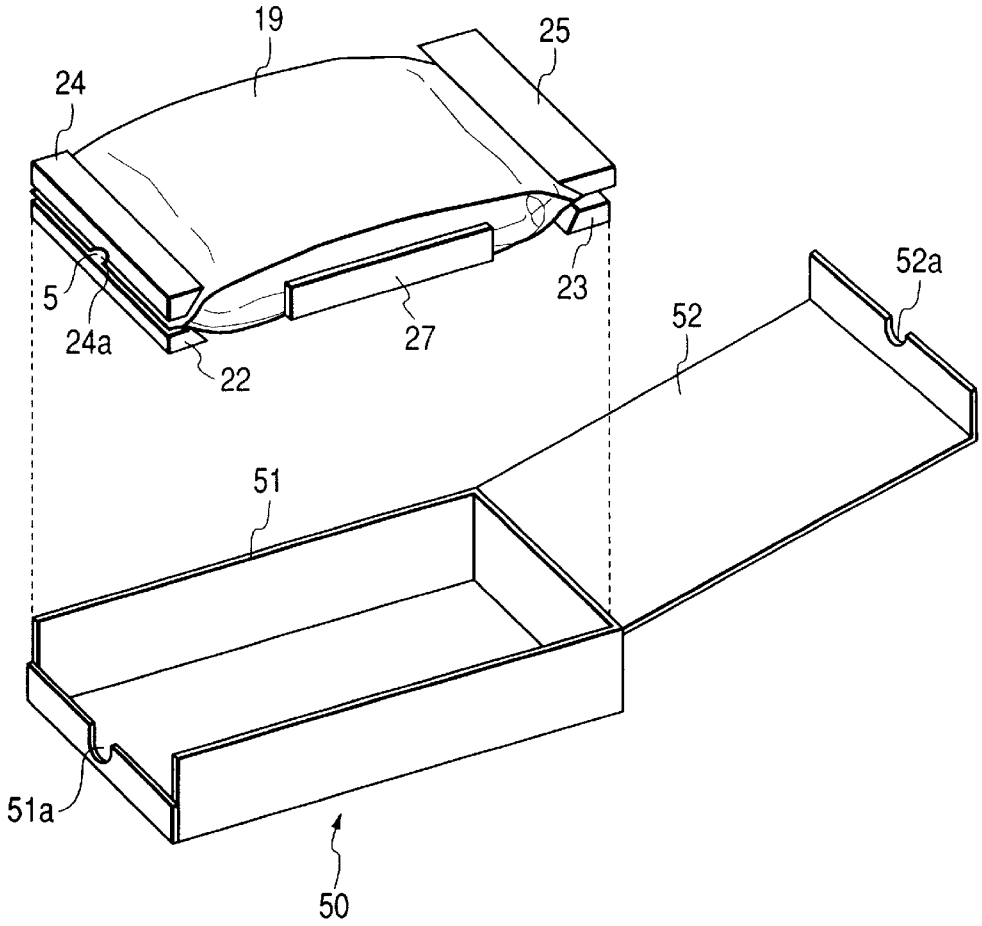
FIG. 13 shows a perspective view of yet another package according the invention, showing a state in which an ink bag is taken out therefrom; and, FIG. 14 is a perspective view showing an assembly of a related ink bag.
Figure 14:
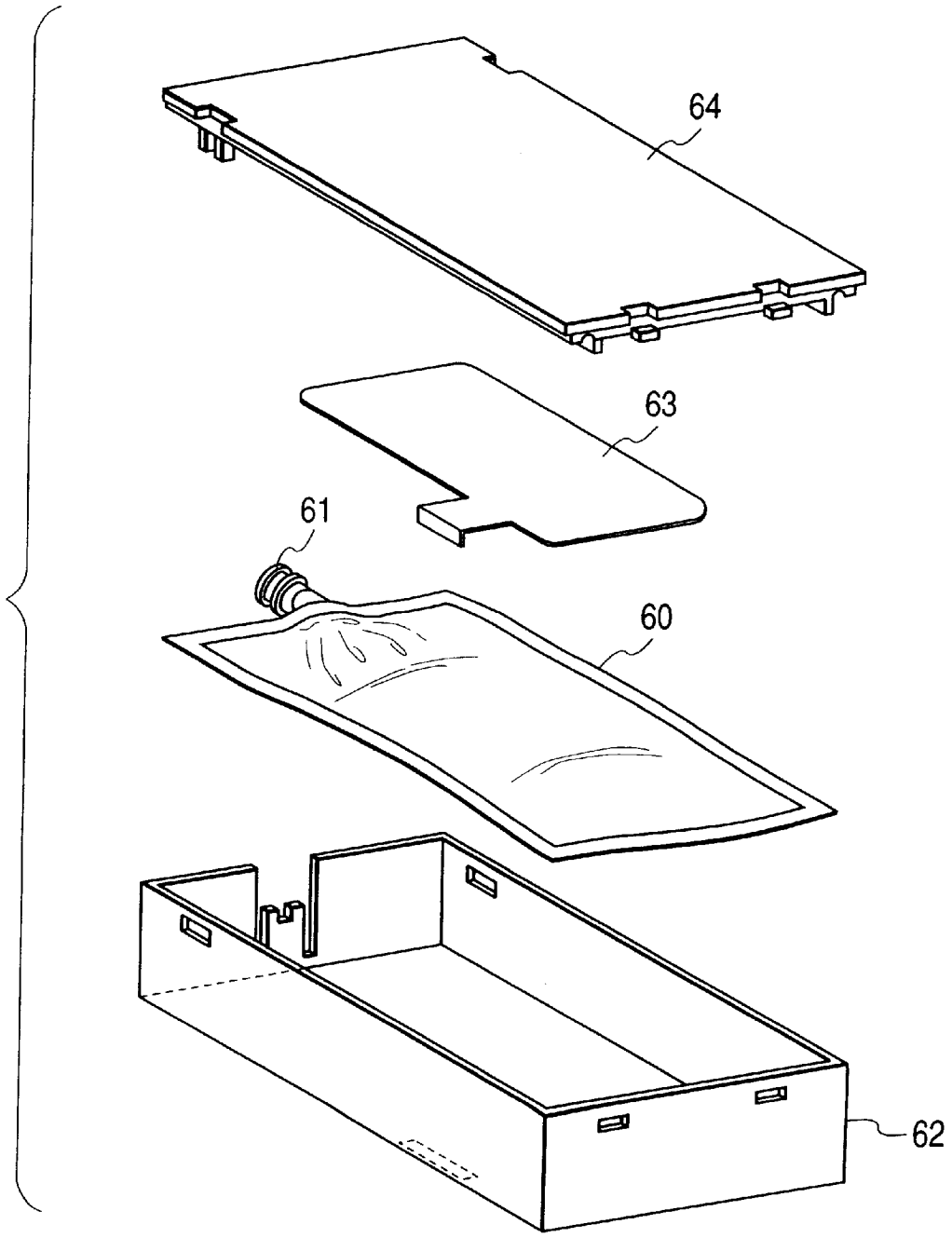

In the above-mentioned embodiment, the package is formed or molded into a developed shape. However, according to the invention, it is also possible to employ such an embodiment as shown in FIG. 13: that is, a package 50 is made up of a box-shaped main body portion 51 and a cover portion 52 continuous with the one side of the main body portion 51; recesses 51*a* and 52*a* serving as windows from which the ink supply hole forming member 5 can be exposed are formed on the overlapping side of the main body portion 51 and cover portion 52; and a recess 24*a* is formed on one of the end portion inner packing members 22 and 24 situated on the side of the ink supply hole forming member 5.

In this embodiment, the end portion inner packing members 22, 24 and 23, 25 are mounted onto the longitudinal end portions of the ink bag 19, and the side surface inner packing members 27 (26) are mounted onto the side surfaces of the ink bag 19; if necessary, after secured provisionally, these packing members and ink bag are stored into the main body portion 51; and, the cover portion 52 is closed, thereby completing the package 50. After then, similarly to the above-mentioned embodiment, the package 50 may be stored into the ink leakage preventive bag 30, and the ink leakage preventive bag 30 may be structured as a vacuum pack.

According to the present embodiment, similarly to the above-mentioned embodiment, the ambient air pressure is allowed to act uniformly on the outer peripheries of the main body portion 51 and cover portion 52 whereas the resisting forces of the end portion inner packing members 22 to 25 act on the inner surfaces of the main body portion 51 and cover portion 52, thereby being able to maintain the box shape of the package 50. And, if the ink bag 19 is taken out from the ink leakage preventive bag 30 or the vacuum pack 30, then the ink bag 19 can be mounted to the recording apparatus in a state that the ink bag 19 is stored within the package 50.

In the aforementioned embodiments, the ink bag 19 is constructed such that the second films 3 and 4 are disposed on the longer sides of the first films 1 and 2, and the ink supply hole forming member 5 is disposed on the shorter sides of the first films 1 and 2. The present invention should not be restricted thereto or thereby. For example, the ink bag 19 maybe constructed such that the second films 3 and 4 are disposed on the shorter sides of the first films 1 and 2, and the ink supply hole forming member 5 is disposed on the longer sides of the first films 1 and 2. Further, each of the first films 1 and 2 may be formed to have a regular rectangular shape or a perfect square shape. Moreover, each of the first films 1 and 2 may be formed to have a trapezoidal shape.

In the aforementioned embodiments, the thermal fusion is utilized to combine the first films 1 and 2, the second films 3 and 4 and the supply hole forming member 5 together. Although the thermal fusion simplifies the manufacturing process for the ink bag 19, the present invention should not be restricted thereto or thereby, and any suitable attachment method, such as adhesive, may be applied in place of the thermal fusion.

What is claimed is:

1. An ink bag for an ink jet type recording apparatus, the ink bag comprising:

a pair of first films, each having first opposing sides, and second opposing sides each connecting the first opposing sides;

a pair of second films, each having third opposing sides, and fourth opposing sides each connecting the third opposing sides, wherein the second films are lower in rigidity than the first films, and the third sides of each second film are respectively attached to a corresponding first side of one of the first films and a corresponding first side of the other of the first films; and an ink supply hole forming member attached to a corresponding one of the second sides of each first film;

wherein the rest of the second sides of one first film is partially attached to the rest of the second sides of the other first film.

2. The ink bag according to claim 1, further comprising:

connecting portions disposed at respective corners of the first films, each of the connecting portions being in the form of a strip and connecting the first sides of the first films to the second sides of the first films.

3. The ink bag according to claim 2, wherein each of the connecting portions connects mutually contacting surfaces of the first and second films.

4. The ink bag according to claim 2, wherein each of the connecting portions connects mutually contacting surfaces of the first and second films and mutually contacting surfaces of a corresponding second film.

5. The ink bag according to claim 1, wherein each of the second films has a central line at which each second film is likely to be folded.

6. The ink bag according to claim 2, wherein each of the second films has a central line at which each second film is likely to be folded, and the central line of each second film extends across corresponding connecting portions when each second film is folded.

7. The ink bag according to claim 1, wherein each of the first films has a laminated structure including a polyethylene layer, a polyester layer, a metal layer and another polyester layer laminated one on another in this order, and each of said second film has a laminated structure including a polyethylene layer, a metal layer and a nylon layer laminated one on another in this order, wherein mutually contacting surfaces of the polyethylene layers are attached together by thermal fusion.

8. The ink bag according to claim 7, wherein a nylon layer is interposed between the polyethylene layer and the metal layer.

9. The ink bag according to claim 1, wherein each of the first and second films is thermally fusible.

10. The ink bag according to claim 1, wherein the first sides of the first films are longer in length than the second sides of the first films.

11. An ink bag package for an ink jet type recording apparatus, comprising:

the ink bag of claim 1;

end portion inner packing members, each having a trapezoidal-shaped section, and each disposed on a respective one of the second sides of the first films;

side surface inner packing members each disposed between the first films and each contacted with a respective one of the second films; and, a container storing therein the ink bag, and the packing members.

12. The ink bag package according to claim 11, wherein the container includes a box-shaped container main body and a box-shaped upper cover, and a depth L1 of the container main body is smaller than a maximum thickness d of the ink bag.

13. The ink bag package according to claim 12, wherein a vertical total height L2 of the end portion inner packing members of a pair vertically holding a second side of one first film and a corresponding second side of the other first film therebetween is larger than the depth L1 of the container main body and smaller than the maximum thickness d of the ink bag.

14. The ink bag package according to claim 13, further comprising:

an adhesive tape fixing the container main body and the upper cover to each other.

15. The ink bag package according to claim 12, further comprising:

an adhesive tape circumscribing longitudinally central portions of the container main body and the upper cover, to thereby fix the container main body and the upper cover to each other.

16. The ink bag package according to claim 11, further comprising:

a vacuum pack enclosing the container therein.

17. The ink bag package according to claim 11, wherein each of the side surface inner packing members is rectangular in section.

18. A method of manufacturing the ink bag of claim 1, comprising the steps of:

(a) attaching the third sides of each second film to a corresponding first side of one of the first films and a corresponding first side of the other of the first films by thermal fusion to thereby form a cylindrical body having openings at respective ends;

(b) applying heat to one of the openings to close the one of the openings by thermal fusion; and (c) applying heat to the other of the openings to sealingly attach the ink supply hole forming member to the other of the openings by thermal fusion to thereby form an ink bag.

19. The method according to claim 18, further comprising:

attaching mutually contacting surfaces of an inner side of the ink bag at four corner portions of the ink bag, to thereby provide connecting portions connecting the first sides of the first films to the second sides of the first films.

20. The method according to claim 18, further comprising:

attaching mutually contacting surfaces of an inner side of the ink bag at four corner portions of the ink bag and attaching mutually contacting surfaces of an outer side of the ink bag at the four corner portions of the ink bag, to thereby provide connecting portions connecting the first sides of the first films to the second sides of the first films.

21. The method according to claim 18, wherein said steps (a), (b) and (c) is carried out such that the first films are aligned together in a state that the second films each folded along a center line are interposed therebetween, and heat is then applied to the first to fourth sides of the first and second films.

22. The ink bag according to claim 1, wherein each of said first films is rectangular.

23. The ink bag according to claim 1, wherein each of said second films is rectangular.

24. The ink bag according to claim 22, wherein said first sides are longer than said second sides.

25. The ink bag according to claim 22, wherein said first sides are shorter than said second sides.

26. The ink bag according to claim 22, wherein each of said first films is a perfect square.

27. The ink bag according to claim 22, wherein each of said first films is trapezoidal.

28. The ink bag according to claim 1, wherein each of the first films has a laminated structure including a polyethylene layer, a nylon layer, a metal layer and a polyester layer laminated one on another in this order.

* * * * *